US005853636A

United States Patent [19]

Munekiyo et al.

[11] Patent Number: 5,853,636

[45] Date of Patent: Dec. 29, 1998

[54] FIBER TREATMENT COMPOSITION

[75] Inventors: Takeshi Munekiyo, Yao; Tamotsu Matsunaga, Nabari; Hirofumi Ishida, Yao, all of Japan

[73] Assignee: Matsumoto Yushi-Seiyaku Co., Ltd., Osaka, Japan

[21] Appl. No.: 875,478

[22] PCT Filed: Nov. 28, 1996

[86] PCT No.: PCT/JP96/03477

§ 371 Date: Jul. 29, 1997

§ 102(e) Date: Jul. 29, 1997

[87] PCT Pub. No.: WO97/20100

PCT Pub. Date: Jun. 5, 1997

[30] Foreign Application Priority Data

Nov. 29, 1995 [JP] Japan ..... 7-310694

[51] Int. Cl.[6] ..... D01D 5/08; D06M 15/59

[52] U.S. Cl. ..... 264/129; 264/130; 264/211.14; 524/386; 524/387; 524/555; 524/765; 524/801; 524/827

[58] Field of Search ..... 264/129, 130, 264/211.14; 524/386, 387, 555, 765, 801, 827

[56] References Cited

U.S. PATENT DOCUMENTS

| | | | |
|---|---|---|---|
| 5,187,219 | 2/1993 | Furman, Jr. | 524/386 X |
| 5,399,616 | 3/1995 | Kuhn et al. | 524/765 |

FOREIGN PATENT DOCUMENTS

| | | | |
|---|---|---|---|
| 45-683 | 1/1970 | Japan | 264/211.14 |
| 59-211680 | 11/1984 | Japan . | |
| 63-6198 | 1/1988 | Japan . | |
| 63-28977 | 2/1988 | Japan | 264/211.14 |
| 2-68370 | 3/1990 | Japan . | |
| 4-199218 | 4/1992 | Japan . | |
| 5-105728 | 4/1993 | Japan . | |
| 6-173168 | 6/1994 | Japan . | |
| 7216734 | 8/1995 | Japan . | |

*Primary Examiner*—Leo B. Tentoni
*Attorney, Agent, or Firm*—Stevens, Davis, Miller & Mosher, L.L.P.

[57] ABSTRACT

A fiber treating composition and the emulsion of the composition, containing poly-N-vinylalkylamides and/or copolymers thereof, and polyols and/or derivatives thereof; and a synthetic filament production process with melt-spinning at 1,000 m/min or more spinning speed, wherein the above fiber treating composition is applied.

11 Claims, No Drawings

FIBER TREATMENT COMPOSITION

FIELD OF THE INVENTION

The present invention relates to a fiber treating composition for producing synthetic filaments, in particular, to a fiber treating composition applied in a high-speed spinning process of synthetic filaments.

DESCRIPTION OF THE PRIOR ART

For the purpose of facilitating the production processes of synthetic filament, a fiber treating composition is applied to impart lubricity, cohesion, and antistaticity to synthetic filaments.

Recently, constant effort for improving fiber production efficiency by increasing processing speed has achieved high-speed fiber production at 5,000–8,000 m/min. Such a speedup of fiber production process will probably be accelerated in the future.

For increasing fiber production speed, the modification of fiber production machinery is required at first, and the modification of fiber treating composition is also required. Increased fiber production speed requires correspondingly high performance of fiber treating compositions, such as superior lubricity, filament cohesion and antistaticity.

Furthermore, uniform and sufficient coating of fiber treating composition on fiber surface is also important for high-speed fiber production, and is noted by those skilled in the art.

A fiber treating composition is usually applied to fibers in spinning process with metering-pump, which constantly feeds the aqueous emulsion of a fiber treating composition, or with kiss roll. The filament applied with the fiber treating composition is then processed in spin-draw system where the filament is drawn between first and second godet rolls at an optimum draw ratio (3 to 5 times) and wound into packages; or in high-speed spinning system where the filament is wound into packages without drawing.

With the increase of fiber production speed, sling off or insufficient application of fiber treating composition is apt to increase leading to uneven application of fiber treating composition on filament yarns. Uneven or insufficient application of fiber treating composition causes yarn breakage, fluffs, nonuniform yarn thickness, and dye defect, because of the severe processing condition of high-speed production. Those troubles result in serious problems, such as increased production cost and decreased yarn quality.

Under such situation, a fiber treating composition, which adsorbs sufficiently to filament surface with minimum sling off has been required.

For meeting such requirement, a fiber treating composition containing high molecular weight polyethylene oxide has been proposed in Japanese Patent Publication KOKAI (Provisional publication) H2-68370.

However, the above high molecular weight component caused scum accumulation on guides and godet rolls in spinning and processing of filament yarns resulting in increased or varied friction at filament-to-guide or roll interface. The increased or varied friction caused frequent yarn breakage and fluffs, and thus decreased yarn production efficiency and yarn quality.

Another fiber treating composition proposed in Japanese Patent Publication KOKAI (Provisional publication) H4-119128 contained a polymer derived from a polyoxyalkylene compound and an organic polyisocyanate compound for the purpose of preventing the sling off of the emulsion of the fiber treating composition and minimizing scum generation. However, the above composition was not practicable because of the poor compatibility of the polymer with other components. The polymer could merely be suspended in the composition with the aid of water as a medium, and easily separated from other components when the filament applied with the composition was dried. The separated polymer changed into sticky substance on filament surface, and caused sticky scum accumulation on guides, which was accelerated with comparatively high pickup level, 0.2 to 1.5% of fiber weight, required to the composition. Thus an ideal fiber treating composition for high speed production process of synthetic filament yarns has not been developed.

DETAILED DESCRIPTION OF THE INVENTION

The object of the present invention is to provide a fiber treating composition which can adsorb uniformly on filament surface, with minimum troubles in spinning, such as scum generation, and hardly slings off from filament, even in a high-speed spinning of synthetic fibers.

The present invention relates to a fiber treating composition and the emulsion of the said composition, which comprises poly-N-vinylalkylamides and/or copolymers thereof, consisting of the basic unit represented by Formula (I),

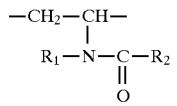

(I)

Wherein $R_1$ is a hydrogen atom or an alkyl group having 1 to 3 carbon atoms, and $R_2$ is an alkyl group having 1 to 5 carbon atoms; and water-soluble polyols having two or more hydroxyl groups and/or derivatives thereof.

The present invention further relates to a method for producing synthetic fibers, in which the above fiber treating composition is applied to filaments extruded from spinnerettes at a spinning rate of 1,000 m/min or more.

The object of the present invention is achieved with a fiber treating composition, which is the blend of a known fiber treating composition, the above poly-N-vinylalkylamides exemplified by poly-N-vinylacetamide and/or copolymers thereof, and water-soluble polyols having two or more hydroxyl groups and/or derivatives thereof. Those components blended in the known fiber treating composition contribute to the prevention of the sling off of fiber treating composition in high-speed fiber production, which has not been achieved by conventional fiber treating compositions. Furthermore, the fiber treating composition exhibits an excellent performance in scum prevention, which has not been achieved by high molecular weight polyethylene oxides.

The principal chains of the above poly-N-vinylalkylamides and copolymers thereof comprise the structural unit represented by the above Formula (I). The average molecular weight of the said polymers and copolymers is preferably from 10,000 to 10,000,000. The polymers and copolymers of which average molecular weight is less than 10,000 exhibit insufficient preventability of sling off of fiber treating composition, and those of which average molecular weight is more than 10,000,000 increase scum accumulation on guides and rollers in fiber production process due to its poor compatibility to other components of the fiber treating composition. The most preferable average molecular weight of the said polymers and copolymers for preventing the sling off of fiber treating composition and achieving its easy handling ranges from 10,000–5,000,000.

The copolymers of poly-N-vinylalkylamides comprises N-vinylalkylamide represented by the Formula (II),

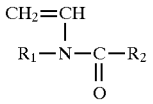

(II)

Wherein $R_1$ is a hydrogen atom or an alkyl group having 1–3 carbon atoms, and $R_2$ is an alkyl group having 1–5 carbon atoms; and 50 mol % or less of one or more monomers copolymerizable therewith. Monomers copolymerizable with the said N-vinylacetamide are selected among acrylic acids and their esters, methacrylic acids and their esters, acrylamides and vinyl acetate.

The poly-N-vinylalkylamides and their copolymers can be synthesized by radical polymerization.

The poly-N-vinylalkylamides and/or the copolymers thereof used in the present invention can be solubilized in a fiber treating composition by combining them with water-soluble polyols having two or more hydroxyl groups and/or derivatives thereof. Therefore, poly-N-vinylalkylamides and/or copolymers thereof can remain solubilized in the treating composition applied to fibers even after drying, and can retain the fluidity of the fiber treating composition on fiber. In addition, such fiber treating composition prevents scum accumulation on guides and rollers, since it doesn't deposit solids or sticky substance. The preferred blend ratio of poly-N-vinylalkylamides and/or copolymers thereof, and water-soluble polyols having two or more hydroxyl groups and/or derivatives thereof is from 1:5 to 1:300. The preferred ratio of a poly-N-vinylalkylamides and/or copolymers thereof in a fiber treating composition of the present invention is from 0.0001 to 0.5% by weight, and more preferred is from 0.001 to 0.3% by weight. A ratio less than 0.0001% by weight increases the sling off of the fiber treating composition, and a ratio more than 0.5% by weight increase the stickiness of the fiber treating composition on filament surface.

Poly-N-vinylalkylamides and/or copolymers thereof; and water-soluble polyols and/or derivatives thereof may be dissolved at a predetermined ratio to make a solution, and then added into a fiber treating composition or an emulsion of the fiber treating composition.

In the present invention, the said water-soluble polyols and/or derivatives thereof are used in order to solubilize the poly-N-vinylalkylamides and/or copolymers thereof in other components of a fiber treating composition and to prevent the composition from depositing on fiber surface after the water in the composition evaporates in fiber drying process.

The said water-soluble polyols of the present invention are selected among alkylene glycols, polyalkylene glycols, polyols having three or more hydroxyl groups and alkylene oxide adducts of the polyols. The preferred alkylene glycols include glycols having 2 to 10 carbon atoms, such as ethylene glycol, propylene glycol, diethylene glycol, triethylene glycol, tetraethylene glycol, butylene glycol, dibutylene glycol, neopentyl glycol, and dineopentyl glycol. The preferred polyalkylene glycols include the homopolymers of the above alkylene glycols, and the block or random copolymers of two or more alkylene glycols. The preferred carbon atoms contained in the said polyalkylene glycols is 100 or less. The polyalkylene glycols having more than 100 carbon atoms are not preferred because of their poor compatibility with other components in the fiber treating composition. The said polyols having three or more hydroxyl groups include glycerin, polyglycerins such as diglycerin, pentaerythritol, dipentaerythritol, trimethylolpropane, and sorbitol. The said alkylene oxide adducts of the said polyols having three or more hydroxyl groups include ethylene or propylene oxide adducts of the polyols, and the adducts with two or more alkylene oxide variants. The preferable molecular weight of the adducts is 1,000 or less. Other polyols applicable to the present invention are alkylene oxide adducts of bisphenol A and catechol.

The said derivatives of the water-soluble polyols include those having at least two hydroxyl groups such as monoglycerides e.g., glycerin-monolaurate, diglycerin-monooleate and polyglycerin-monolaurate; esters of polyols having three or more hydroxyl groups and carboxylic acids e.g., sorbitan-monoalkylates, alkyldiglycerides and pentamonoesters; alkylene oxide adducts of polycarboxylic acid polyamides; and alkanolamines e.g., triethanolamine. The preferable derivatives of the water-soluble polyols are water-soluble derivatives having a molecular weight of 1,000 or less and a HLB value of 8 or more, because of their compatibility to other components in fiber treating composition, and sufficient lubricity. More preferable are those which are liquid at room temperature and have a boiling point of 150° C. or more under atmospheric pressure.

The most preferable water-soluble polyols and derivatives thereof include diglycerin, diethyleneglycol, diglycerin-monolaurate and polyglycerin dilaurate.

The preferable ratio of the water-soluble polyols having two or more hydroxyl groups and derivatives thereof in the fiber treatment composition of the present invention is 0.0005 to 5% by weight, and more preferably 0.005 to 2% by weight. The ratio beyond the above range is not preferred, because the ratio less than 0.0005% by weight is apt to cause scum generation, and the ratio more than 5% by weight is too high to disperse the components homogeneously into the mixture of other components.

The major components usually blended in conventional fiber treating composition, such as lubricants, emulsifiers or antistatic agents may be blended in the fiber treating composition of the present invention. The said lubricants include mineral oils e.g., liquid paraffin; aliphatic monoesters e.g., isooctyl stearate, lauryl oleate, isotridecyl stearate and isostearyl oleate; dibasic acid diesters e.g., dilauryl adipate and dioleyl adipate; polyol esters e.g., trimethylolpropane trilaurate and coconut oil; and EO/PO polyethers. The said emulsifiers include polyoxyethylene oleyl ether, polyoxyethlene nonyl phenyl ether and polyoxyethylene castor-oil ether, and the said antistatic agents include polyoxyethylene oleylphosphate and partially or completely neutralized salts thereof with sodium, potassium or amine salts, sodium dioctylsulfosuccinate, and alkanesulfonate.

Additives such as, penetrants, phase-inversion viscosity degraders, surface tension degraders, and abrasion-preventive agents may be blended, if necessary, in the fiber treating composition of the present invention.

The fiber treating composition of the present invention is applicable in the producing and processing of synthetic multifilaments comprising polyamides or polyesters.

The fiber treating composition of the present invention is applied to fiber in spinning process in an aqueous emulsion of 5 to 30% by weight concentration, preferably of 10 to 25% by weight concentration with kiss roll or metering pump. The preferred pickup level of the composition is 0.3 to 3% of fiber weight, more preferably 0.4 to 1.5% of fiber weight.

The fiber treating composition of the present invention markedly improves the efficiency of high-speed fiber production (at 1,000 m/min or more) and also improves yarn quality. The said composition is especially suitable for high-speed production processes, such as high-speed spinning system or spin-draw system, in which filament is wound up into packages at 3,000 m/min or more, or sometimes at 5,000 m/min or more, and can markedly decrease fluffs, yarn breakage, nonuniform yarn thickness and dye defect.

EMBODIMENTS OF THE INVENTION

The best modes of the carrying out of the present invention are listed as follows.

(i) the invention is embodied in a composition as hereinafter defined, wherein the average molecular weight of the contained poly-N-vinylalkylamides is 10,000 to 10,000,000.

ii) the invention is embodied in a composition as hereinafter defined, wherein the ratio of the poly-N-vinylalkylamides in the composition is 0.001 to 0.3% by weight.

(iii) the invention is embodied in a composition as hereinafter defined wherein the ratio of the water-soluble polyols having two or more hydroxyl groups and/or derivatives thereof in the composition is 0.005 to 2% by weight.

(iv) the invention is embodied in a composition as hereinafter defined, wherein the ratio of the said poly-N-vinylalkylamides, and the said water-soluble polyols and/or derivatives thereof is from 1:5 to 1:300.

(v) the invention is embodied in a composition as hereinafter defined, wherein the average molecular weight of the said poly-N-vinylalkylamides is 10,000 to 10,000,000.

The invention will now be further described in the following specific examples, which are regarded as illustrative and not as restricting the scope of the invention.

EXAMPLES 1–5 AND COMPARATIVE EXAMPLES 1–7

Mixtures of emulsions were prepared by blending the poly-N-vinylacetamide dissolved in the polyol or its derivatives described in Table 1 with the 10% aqueous emulsion of the base oil of which major components were mineral oils and fatty acid esters, (Trade name: TERON E-2075, produced by MATSUMOTO YUSHI-SEIYAKU CO., LTD.) to be applied in high-speed production process of polyester textile filaments. The amount of the poly-N-vinylacetamide in polyol and the blend ratio of its solution are described in Table 1.

The performance of the prepared mixtures as a fiber treating composition was tested as described below.

TABLE 1

| | Example | | | | | Comparative Example | | | | | | |
|---|---|---|---|---|---|---|---|---|---|---|---|---|
| Test No. | 1 | 2 | 3 | 4 | 5 | 1 | 2 | 3 | 4 | 5 | 6 | 7 |
| poly-N-vinylacetamide MW = 100,000–750,000 | 0.1 | 0.01 | 0.005 | | | 0.5 | 0.1 | | | | | |
| poly-N-vinylacetamide MW = 10,000–300,000 | | | | 0.1 | 0.03 | | | 0.03 | | | | |
| polyethylene oxide MW = 4,300,000–4,800,000 | | | | | | | | | 1.0 | | | |
| polyurethane from PO/EO(50/50) polyether (MN = 2,000) and 4,4'-dephenylmethanediisocyanate | | | | | | | | | | 0.5 | | |
| glycerin | 1.0 | | | | | | 0.3 | | | | | |
| diethyleneglycol | | 0.1 | | | | | | | | | | |
| diglycerin-monooleate | | | 0.05 | 5.0 | 1.0 | | | 0.1 | | | | 0.1 |
| base oil solution* | 100 | 100 | 100 | 100 | 100 | 100 | 100 | 100 | 100 | 100 | 100 | 100 |

*[TERON E-2075, produced by MATSUMOTO YUSHI-SEIYAKU CO., LTD.]

EXAMPLE 6

A mixture of emulsions was prepared and tested in the same manner as Example 1, except that poly-N-vinylbutylamide (MW=100,000–750,000) was used in the place of the poly-N-vinylacetamide.

EXAMPLE 7

A mixture of emulsions was prepared and tested in the same manner as Example 1, except that a copolymer (MW=100,000–750,000) of N-vinylacetamide (80% by weight) and vinyl acetate (20% by weight) was used in place of poly-N-vinylacetamide.

The result of the test of Examples 1 to 7 and Comparative Examples 1 to 7 are shown in Table 2.

TABLE 2

| | Example | | | | | | | Comparative Example | | | | | | |
|---|---|---|---|---|---|---|---|---|---|---|---|---|---|---|
| Test No. | 1 | 2 | 3 | 4 | 5 | 6 | 7 | 1 | 2 | 3 | 4 | 5 | 6 | 7 |
| compatibility after drying | ○ | ○ | ○ | ○ | ○ | ○ | ○ | X | X | X | X | X | ○ | ○ |
| amount of emulsion slung off (mg) | 15 | 18 | 24 | 12 | 20 | 26 | 30 | 13 | 10 | 28 | 30 | 45 | 450 | 460 |

TABLE 2-continued

| | Example | | | | | | | Comparative Example | | | | | | |
|---|---|---|---|---|---|---|---|---|---|---|---|---|---|---|
| Test No. | 1 | 2 | 3 | 4 | 5 | 6 | 7 | 1 | 2 | 3 | 4 | 5 | 6 | 7 |
| adsorptivity of emulsion (%) | 88 | 85 | 83 | 90 | 85 | 82 | 80 | 87 | 88 | 80 | 82 | 79 | 68 | 70 |
| accumulation of scum | ○ | ○ | ○ | ○ | ○ | ○ | ○ | X | Δ | Δ | X | X | ○ | ○ |
| fluctuation of yarn tension (g) | 0.5 | 0.5 | 0.6 | 0.6 | 0.5 | 0.5 | 0.5 | 2.0 | 1.5 | 1.0 | 3.5 | 3.3 | 0.5 | 0.5 |

As shown in Table 2, the fiber treating compositions of the present invention (Examples 1 to 7) exhibited significantly lower amount of emulsion slung off and superior adsorptivity than conventional compositions. Furthermore the compositions of the present invention rarely caused scum accumulation owing to their excellent compatibility after drying, and thus exhibited minimum fluctuation of yarn tension.

Test Methods (1) Compatibility of composition after drying: Each of the mixtures of emulsions was prepared into 10% aqueous emulsion, and 1 g of the aqueous emulsion was placed in a laboratory dish (100 mm in diameter) and dried at 105° C. for 2 hours. The dried up composition was visually observed to assure whether any solids or gels appeared.

[Criteria]

No solids and no gels: ○

Appearance of a trace of solids or gels: ΔAppearance of solids or gels: x (2) Amount of emulsion slung off from fiber: Each of the mixtures of emulsions was prepared into 10% aqueous emulsion and applied to a deoiled commercial polyester filament yarn (150 d/48 f) driven at 1,500 m/min with metering pump. The emulsion dropped just after the metering-pump application was trapped into a watch glass, and the dropped amount (mg) per minute was determined.

(3) Adsorptivity of emulsion: Approx. 2 g of a filament yarn applied with one of the test aqueous emulsion in the above test was sampled. The fiber treating composition on the sampled filament yarn was extracted with n-hexane by using rapid extraction apparatus (TOKAI KEIKI) in order to determine the amount of the fiber treating composition. The amount of the composition was calculated into the percentage of filament weight (OPU) and further calculated into adsorptivity of the composition by the following formula.

$$\text{Adsorptivity (\%)} = \frac{\text{Calculated } OPU \text{ (\%)}}{\text{Theoretical } OPU \text{ (\%)}} \times 100$$

The theoretical OPU (%) was calculated by the following formula from the amount of the aqueous emulsion fed from metering pump.

$$\text{Theoretical } OPU \text{ (\%)} = \frac{\text{Feeding rate of emulsion (g/min)} \times \text{concentration of emulsion (\%)} \times 9{,}000}{\text{Yarn velocity (m/min)} \times \text{yarn denier}}$$

(4) Scum: A given length (6000 m) of the yarn applied with each of the aqueous emulsions was driven on a matte chrome pin (40 mm in diameter) at 200 m/min, with 25 g initial tension and 180° contact angle. The accumulation of scum on the pin was visually observed.

[Criteria]

Little scum: ○

A small amount of scum: Δ

A large amount of scum: x (5) Fluctuation of yarn tension: In the above scum test, yarn tension was measured after the yarn passed on the matte chrome pin (40 mm in diameter), and calculated by the following formula.

$$\text{Fluctuation of yarn tension } (\Delta T) = T_2 - T_1$$

where $T_1$ is the initial tension and $T_2$ is the average yarn tension of 6,000 m of yarn driven on the pin.

As apparent from the above results, the fiber treating composition of the present invention hardly slings off from yarn running at high-speed, and has excellent adsorptivity on yarn and excellent scum-preventive performance. Thus, the fiber treating composition of the present invention improves the processing efficiency of high-speed filament yarn production and the quality of filament yarn.

What is claimed is:

1. A fiber treatment composition which comprises (1) at least one member selected from the group consisting of poly(N-vinylalkylamides) having repeating units of formula I:

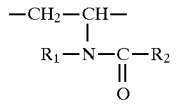

(I)

in which $R_1$ is H or an alkyl group having 1–3 carbon atoms, and $R_2$ is an alkyl group having 1–5 carbon atoms and copolymers containing the N-vinylalkylamide units in the amount of not less than 50 mol %; and (2) di- or more valent water soluble polyols and/or derivatives thereof; in the weight ratio of (1):(2) being 1:5 to 1:300.

2. A fiber treating composition defined in claim 1, wherein the base fiber treating composition is an aqueous emulsion.

3. An aqueous emulsion of the fiber treating composition comprising the poly-N-vinylalkylamides defined in claim 1, and glycerin and/or polyglycerin.

4. A fiber treatment composition defined in claims 1, wherein the poly-N-vinylalkylamide is poly-N-vinylacetamide.

5. A method for producing synthetic fibers by conducting a melt-spinning process operated at 1,000 m/min or more, wherein the fiber treating composition as defined in claim 1 is applied.

6. A fiber treatment composition defined in claim 2, wherein the poly-N-vinylalkylamide is poly-N-vinylacetamide.

7. A fiber treatment composition defined in claim 3, wherein the poly-N-vinylalkylamide is poly-N-vinylacetamide.

8. A method for producing synthetic fibers by conducting a melt-spinning process operated at 1,000 m/min or more, wherein the fiber treating composition defined in claim 3 is applied.

9. A method for producing synthetic fibers by conducting a melt-spinning process operated at 1,000 m/min or more, wherein the fiber treating composition defined in claim 4 is applied.

10. A method for producing synthetic fibers by conducting a melt-spinning process operated at 1,000 m/min or more, wherein the fiber treating composition defined in claim 6 is applied.

11. A method for producing synthetic fibers by conducting a melt-spinning process operated at 1,000 m/min or more, wherein the fiber treating composition defined in claim 7 is applied.

* * * * *